United States Patent [19]

Haynes et al.

[11] 4,007,700

[45] Feb. 15, 1977

[54] MULTIPLE SEAFLOOR STORAGE AND SUPPLY SYSTEM

[75] Inventors: Harvey H. Haynes, Camarillo; Norman D. Albertsen, Ojai, both of Calif.; Lawrence F. Kahn, Ann Arbor, Mich.

[73] Assignee: The United States of America as represented by the Secretary of the Navy, Washington, D.C.

[22] Filed: Oct. 28, 1975

[21] Appl. No.: 626,386

[52] U.S. Cl. ..... 114/74 T; 61/101

[51] Int. Cl.[2] ..... B63B 25/08

[58] Field of Search ..... 114/.5 T, 74 T, 65 A; 61/.5, 46.5, 101; 220/13, 18, 1 B, 85 B

[56] References Cited

UNITED STATES PATENTS

| | | | |
|---|---|---|---|
| 1,201,051 | 10/1916 | Jack | 114/.5 T |
| 2,720,082 | 10/1955 | Brandon | 114/.5 T |
| 2,731,168 | 1/1956 | Watts | 114/.5 T |
| 3,322,087 | 5/1967 | Tucker | 114/.5 T |
| 3,477,401 | 11/1969 | Hayama | 220/85 B |
| 3,708,986 | 1/1973 | Roulet et al. | 114/.5 T |

*Primary Examiner*—Trygve M. Blix
*Assistant Examiner*—Charles E. Frankfort
*Attorney, Agent, or Firm*—Richard S. Sciascia; Joseph M. St.Amand; Darrell E. Hollis

[57] ABSTRACT

The mobile seafloor storage structure for storing POL (petroleum, oils, lubricants) comprising a pair of cylindrically-shaped enclosures having hemispherical-shaped end members. The two cylindrically-shaped enclosures are connected together by top, bottom and end members such that a center enclosure is formed between the pair of cylindrically-shaped enclosures. Various interconnections and related valves are utilized for moving POL, seawater, and gases from enclosure to enclosure thereby maneuvering the structure between the sea surface and the seafloor.

13 Claims, 7 Drawing Figures

(a) OPEN VALVES IN ONE TANK SO THAT POL FLOWS INTO CENTER SPACE (b) STRUCTURE ROTATES SO THAT EMPTY TANK IS ON TOP (c) STRUCTURE IS BALLASTED SUCH THAT A STABLE TILTED POSITION IS ATTAINED (d) WHEN ON SEA BOTTOM, THE EMPTY TANK COMPARTMENTS ARE FLOODED WITH SEAWATER

MULTIPLE SEAFLOOR STORAGE AND SUPPLY SYSTEM

BACKGROUND OF THE INVENTION

1. Field of the Invention

This invention relates generally to underwater storage facilities and more particularly to mobile seafloor storage and supply systems.

2. Description of the Prior Art

Military requirements for POL (petroleum, oils, lubricants) have increased rapidly over the past decade as force mobility has increased.

In World War II, fifty percent of the logistics supply tonnage going to troops overseas consisted of POL products. Estimates indicate that during the Viet Nam conflict this figure jumped to seventy percent of the tonnage supplied, and was rising. This means that those military units charged with the logistics support supply of combat forces must center more attention on POL related systems to meet current demands. Factors such as the continual increase in tonnage required, strategic doctrines that emphasize force mobility, and the loss of foreign bases make it more difficult to meet POL requirements. New concepts must be considered to meet these requirements. The present invention is a new POL storage and supply system that places emphasis on operation from the seafloor and is compatible with anticipated military needs and modes of operation.

Supply of POL to troops at advanced bases is currently achieved by off-loading moored tankers via pipeline to the beach. The POL coming ashore from a tanker is stored in and distributed from advanced base POL facilities such as the Marine Corps amphibious assault fuel system or the Army Tactical Marine Terminal. This approach to POL supply has become unsatisfactory because of rising concern for system security, mobility and capacity that results from changing military operational concepts.

In addition, certain types of landing crafts and lighters that have POL transport capabilities have been utilized occasionally. However, the relatively low storage capacity and high vulnerability of these vessels make them less than ideal candidates for the POL transport and supply mission. Helicopters and air cushion vehicles have also been utilized. These vehicles have high speed capabilities but they use large quantities of fuel and have limited cargo capacities.

Recently two alternative POL supply concepts have evolved. One concept uses POL-filled barges and the other concept utilizes flexible bags. The barge concept utilizes ships to transport the barges to an operational site where they are off-loaded and moored offshore. As needs for the POL develop, the barges are beached and unloaded, or they remain offshore and are unloaded via hoses to the beach. The flexible bag concept uses conventional ships to haul stored collapsible bags to the operational site where they are off-loaded, filled by a tanker and emptied via hose to the beach. Both of these systems having increased mobility over static on-land storage systems and both require a mooring system and are quite vulnerable to enemy actions.

One of the most promising ways to achieve high storage capability and improved security plus system mobility is by utilizing submerged off-shore storage structures. In this way, off-shore storage of POL would be minimized while still utilizing well-developed on-land distribution systems. The result is a system placing POl products in a concealed environment with minimum fire hazard and vulnerability to enemy action. In recent years, several such systems have been developed. However, all such structures have exhibited large buoyant forces which have produced severe anchorage problems and high stresses in the container walls. In addition, only a small percentage of the total volume of the structure could be utilized to store POL and the installation methods which required excessive amounts of time.

SUMMARY OF THE INVENTION

In order to overcome these disadvantages, the present invention provides a mobile seafloor storage structure for storing POL comprising a pair of cylindrically shaped enclosures having hemispherically shaped end members. The two cylindrically shaped enclosures are connected together by top, bottom and aids members such that a center enclosure is formed between the pair of cylindrically shaped enclosures. Various interconnections and related valves are utilized for moving POL, seawater, and gases from enclosure to enclosure, thereby maneuvering the structure between the sea surface and the seafloor.

Accordingly, one object of the present invention is to provide a highly mobile underwater storage system.

Another object of the present invention is to increase efficiency and reduce cost.

Still another object of the present invention is to eliminate the necessity for an auxiliary anchoring system.

Other objects and a more complete appreciation of the present invention and its many attendant advantages will develop as the same becomes better understood by reference to the following detailed description when considered in connection with the accompanying drawings in which like reference numerals designate like parts throughout the figures thereof.

Figure 1:
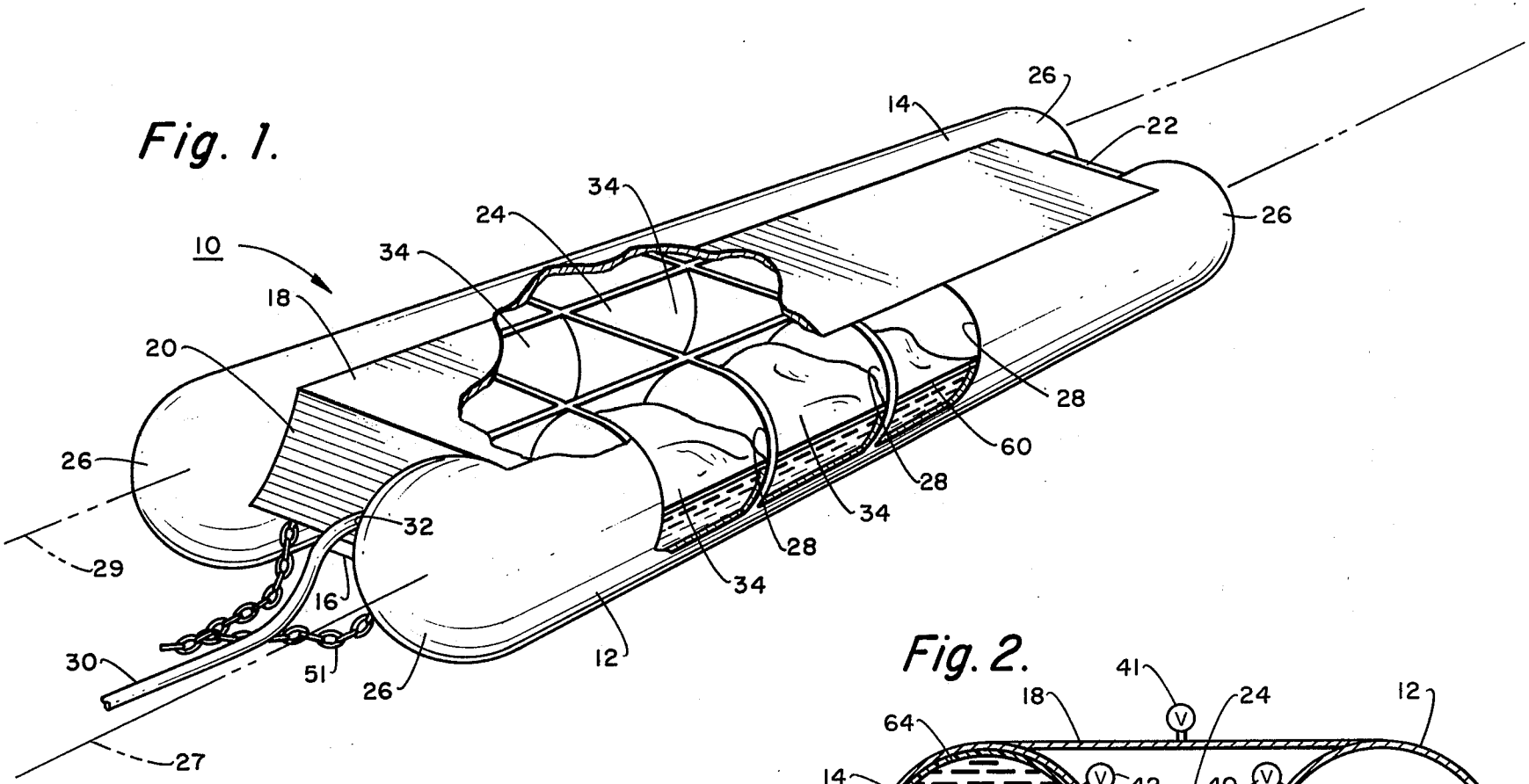
FIG. 1 is an isometric view of one embodiment of the present invention.

FIGS. *4a–4d* illustrates a method of lowering the embodiment of FIG. 1 to the seafloor.

DETAILED DESCRIPTION OF THE PREFERRED EMBODIMENT

Referring now to FIG. 1, the mobile seafloor storage structure for storing POL is indicated generally by the numeral 10. Structure 10 is comprised of two cylindrically shaped enclosures or tanks 12 and 14 connected together by a bottom member or deck 16, a top member or deck 18, and side members 20 and 22. The area bounded by tanks 14 and 12, top member 18, bottom member 16, and side members 20 and 22 comprise center enclosure 24. The volume of enclosure 24 is equal to the volume of either cylindrically shaped tank 12 or 14. Cylindrically shaped tanks 12 and 14 are of equal volume. Of course, unequal volumes may be used in certain situations.

Cylindrically shaped tanks 12 and 14 have hemispherically shaped end members 26. It is noted that the longitudinal axis 27 and 29 of respective cylindrically shaped tanks 12 and 14 are parallel.

Structure 10 is divided into 24 subenclosures 34 by bulkheads 28. Tank 12 is divided into eight subenclosures 34. Tank 14 is divided into eight subenclosures 34. Center enclosure 24 is divided into eight subenclosures 34. It is noted that bulkheads 28 are circular in shape within cylindrically shaped tanks 12 and 14 and are disposed perpendicular to the longitudinal axis 27 and 29 of cylindrically shaped tanks 12 and 14. Bulkheads 28 extend across center enclosure 24 also as shown in FIG. 1.

Structure 10 is fabricated from prestressed concrete for the following reasons. The strength of prestressed concrete enables the structure to resist hogging and sagging caused by conditions encountered on the sea surface; the strength of concrete in compression enables the structure to resist the hydrostatic pressure loads encountered during descent; and the mass of concrete supplies the necessary weight for a highly negatively buoyant structure on the seafloor. Other significant advantages of using prestressed concrete are its excellent durability in seawater which means longlife and low maintenance for structure 10 and the economy of fabricating a structure of concrete compared to other construction materials. It is noted that even though the preferred construction material for structure 10 is prestressed concrete, other equally suited materials may be used.

A pipeline 30 is shown entering structure 10 at point 32. It is noted that pipeline 30 connects to each subenclosure 34 within structure 10. At the points of connection of pipeline 30 to each subenclosure 34 there is located a valve for controlling the flow of storage fluid into that particular subenclosure 34.

Figure 2:
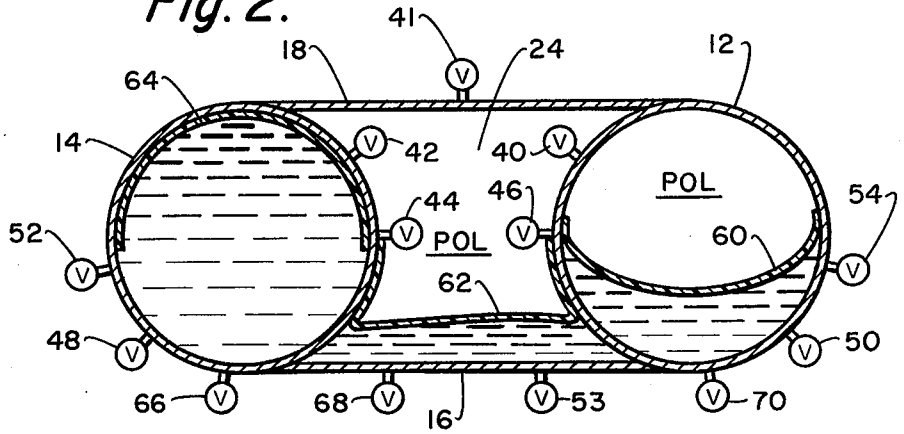
FIG. 2 is a cross-section of the embodiment of FIG. 1.

Now turning to FIGS. 2 and 4, a method of lowering and raising structure 10 will be discussed.

Structure 10 may be towed empty over long distances to the deployment site. Once the deployment site is reached, a tanker (not shown) fills cylindrically shaped enclosures 12 and 14 with POL from pipeline 30. If desired, structure 10 may be towed over long distances with tanks 12 and 14 filled with POL. As shown in FIG. 2, POL from pipeline 30 enters cylindrically shaped tanks 12 and 14 via conduit and valves mechanism 40 and 42, respectively. It is noted that FIG. 2 illustrates only three subenclosures 34 of structure 10. Therefore, there are eight valves and conduits 42 as well as eight valves and conduits 40. It is noted that subenclosures 34 provide structure 10 with the capability of storing more than one type of POL.

Figure 4A:
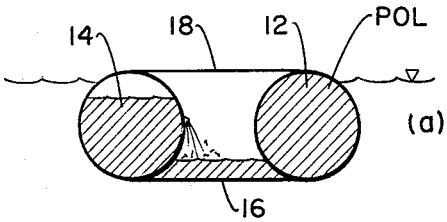
Figure 4B:
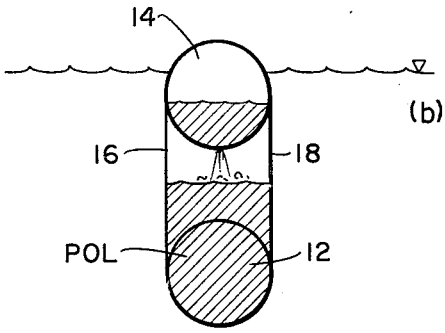

Once at the deployment site, the first step in lowering structure 10 is to open valves 44, thereby allowing the POL contained in cylindrically shaped tank 14 to flow by gravity into enclosure 24. It is noted that each subenclosure 34 of cylindrically shaped tank 14 contains a valve 44. Also, each subenclosure 34 of cylindrically shaped tank 12 contains a valve 46. Valve 46 is utilized for the same function as valves 44 of tank 14. As enclosure 24 fills with the POL drained from tank 14 through valves 44, structure 10 will rotate in the water such that tank 14 is on top, i.e., cylindrically shaped tanks 12 and 14 are vertically disposed as is shown in FIG. 4*b*.

The structure is then rendered negatively buoyant by filling cylindrically shaped tank 14 with seawater through valves 48. It is noted that each subenclosure 34 of tank 14 contains a valve 48. In addition, each subenclosure 34 of tank 12 contains a valve 50 for the identical purpose. It is noted that the amount of seawater injected into cylindrically shaped tank 14 varies with the weight of the POL contained in structure 10. The lighter the POL contained in structure 10, the larger the amount of seawater necessary to render structure 10 negatively buoyant.

Figure 4C:
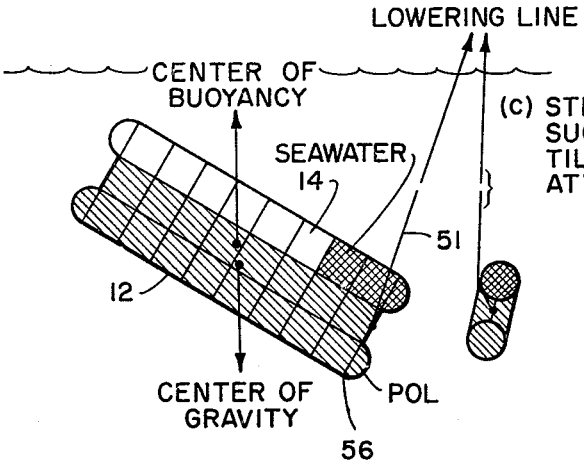

Next, structure 10 is ballasted in such a manner that a stable tilted position is obtained, as is shown in FIG. 4*c*. This ballasting may take the form of injecting additional amounts of seawater into forward subenclosures 34 of tank 14. Other convenient ballasting materials such as sand may be used for this purpose. However, seawater is preferable since it can be ejected from cylindrically shaped tank 14, if necessary.

Structure 10 is then lowered to the seafloor utilizing tow cable 51. As shown in FIG. 1 and FIG. 4*c*, tow cable 51 is attached to one end of structure 10 nearest the ballast material.

As structure 10 approaches the seafloor, its rate of descent is reduced. At touchdown, impact forces are dampened because structure 10 pivots on front end contact point 56. One advantage is that contact point 56 is known, and therefore structure 10 may be designed to withstand the impact forces encountered upon striking the seafloor. Enclosure 24, if desired, may not be pressure resistant. In that case, it would be open to the seawater environment and therefore pressure compensated. Thus, compressed air would not be required to counter hydrostatic loads thereon.

Figure 4D:
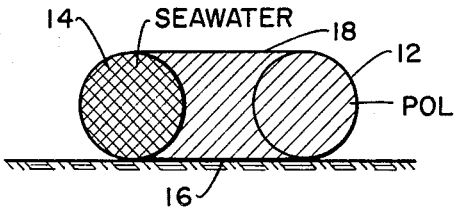

Once on the seafloor, as shown in FIG. 4*d*, valves 52 of cylindrically shaped tank 14 are opened so that any empty or partially filled subenclosures 34 of tank 14 may be filled with seawater. This renders structure 10 highly negatively buoyant, thus increasing the bearing pressures of structure 10 upon the seafloor. These bearing pressures are sufficient to self-anchor structure 10. It is noted that each subenclosure 34 has a separate valve 52 thereto. In addition, cylindrically shaped tank 12 has a series of valves 54 for performing the same purpose as valves 52 of tank 14.

It is envisioned that structure 10 will be placed at depths between 200 and 600 feet beneath the surface. However, if structure 10 should be placed at depths less than 250 feet and large surface waves are generated from storms, there is a possibility that the structure could move horizontally on the seafloor. Hence, it is desirable to locate structure 10 at depths lower than 250 feet where the effect of surface waves on structure 10 is negligible.

Once on the seafloor, POL is extracted from structure 10 by opening solenoid valves 40 and 41, thereby permitting POL to move up pipeline 30. It is noted that there are eight valves 41, one for each subenclosure 34 of center enclosure 24. Valves 40 and 41 are connected to pipeline 30. Since the POL has a lower specific gravity than seawater, a pressure differential is created in the structure 10 pipeline 30 system. This pressure differential is used to "pump" the POL to shore. For example, at a depth of 600 feet, light POL will flow unassisted through 5,000 feet of 6-inch pipe at the rate of 600 gallons per minute. To maintain this flow rate for longer links of pipe or for heavy POL, some pumping may be required.

As POL is removed from structure 10, seawater will enter via valves 52, 53 and 54 so that structure 10 remains full at all times when on the seafloor. It is noted that there are eight valves 52, eight valves 53, and eight valves 54, i.e., one for each subenclosure 34. When completely filled, submerged structure 10 is highly resistant to damage from any underwater explosion.

To avoid contamination of POL with seawater in structure 10, flexible membranes 60, 62 and 64 separate the POL from the seawater within tanks 12, enclosure 24, and tank 14, respectively. It is noted that each subenclosure 34 within tank 12, tank 14 and enclosure 24 contains a separate respective membrane 60, 62 or 64. It is noted that the valves discussed supra are located either above or below membranes 60, 62, and 64, depending on whether they pass seawater or POL.

Seawater is prevented from permeating the concrete wall of structure 10 by an epoxy water-proofing compound coating on the exterior concrete surfaces of structure 10 and also by POL which is at ambient pressure being forced into the voids in the concrete on the inside walls of structure 10. Thus, POL will saturate the concrete walls and thus prevent seawater from contaminating the stored POL.

Retrieval of structure 10 from the seafloor involves making the structure buoyant so that it can rise to the surface. Pipeline 30 can supply compressed air to the structure 10 or compressed air may enter sub-enclosure 34 through valves 48 and 50. As a result, seawater will be displaced by the compressed air and structure 10 can be made buoyant within a wide range of values because any number of subenclosures 34 in the structure may be cleared of seawater and filled with compressed air. In the present invention, the subenclosures 34 of cylindrically shaped tank 14 are blown free of seawater. This may or may not render structure 10 positively buoyant. But even if structure 10 remains negatively buoyant, the moment arm between the center of gravity and the center of buoyancy will cause structure 10 to rotate and thus break out of a mud bottom. Thereafter, filling other subenclosures 34 with compressed air in either enclosure 24 or cylindrically shaped tube 12 will result in a net positive buoyancy for structure 10.

Once structure 10 has broken out of the seafloor and is positively buoyant, it will freely ascend to the surface. As the compressed air expands during ascent, one way valves 66, 68 and 70 of tank 14, enclosure 24, and tank 12, respectively, will vent any excess air pressure, thus maintaining a constant buoyancy for structure 10 throughout ascent. It is noted that structure 10 contains eight valves 66, eight valves 68 and eight valves 70, one for each subenclosure 34. Once structure 10 is on the surface, the remaining seawater can be blown out. Structure 10 is now ready for a new POL supply.

Figure 3:
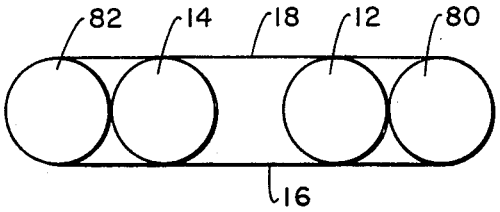
FIG. 3 illustrates an alternative embodiment of the present invention.

Turning to FIG. 3, structure 10 is shown having cylindrically shaped tanks 12, 14, 80 and 82. It is noted that any number of cylindrically shaped tanks may be employed within the scope of the present invention.

In the past few years, the strategic doctrine of the United States has shifted from an emphasis of our nuclear superiority to a reliance on mobile power-deployed amphibious forces to deter crisis and protect U.S. property. The logistics systems that supply amphibious forces must be as mobile and responsive as the forces they supply. The structure 10 is mobile in that structure 10 can be prepositioned, towed to needed areas and transported from place to place to reflect tactical planning within an operational area.

The problem encountered by any large seafloor storage device is the instability of the device caused by surface waves. Long period surface waves produce lift and drag forces that reach up hundreds of feet in depth. Structure 10 was designed to be stabilized by gravity forces and not require any ancillary anchorage systems. This was accomplished by designing structure 10 to be highly negatively buoyant and to have a low profile configuration. In addition, upon initial contact with the seafloor, structure 10 will experience short-term settlement where it will settle to a depth at which the bearing pressure exerted by the structure equals the bearing capacity of the soil of the seafloor. With time, structure 10 will experience long term settlement. Structure 10 acts like a large flat plate, thereby enhancing its own bottom stability.

It is noted that the valves discussed supra are envisioned to be solenoid valves so that they may be operated from the sea surface. In addition, the valves schematically illustrated in FIG. 2 are recessed within structure 10 such that structure 10 presents a smooth surface to the seafloor.

Obviously many modifications and variations of the present invention are possible in light of the above teachings. It is therefore to be understood that within the scope of the appended claims the invention may be practiced otherwise than as specifically described herein.

What is claimed is:

1. A mobile seafloor storage structure for storing a storage fluid therein comprising:
   a. a plurality of cylindrically shaped enclosures having substantially hemispherical-shaped end members, said cylindrically shaped enclosures being adapted to contain said storage fluid;
   b. means disposed between at least two of said cylindrically shaped enclosures for forming a second enclosure, said second enclosure being adapted to contain said storage fluid;
   c. valve means for fluidically connecting each said cylindrically shaped enclosure to or fluidically disconnecting each said cylindrically shaped enclosure from said second enclosure such that said storage fluid may be utilized to shift both the center-of-gravity and the center-of-buoyancy of said seafloor storage structure;
   d. means for injecting said storage fluid into and removing said storage fluid from said cylindrical enclosures and said second enclosure;
   e. means disposed inside each said cylindrically shaped enclosure and inside said second enclosure for creating an upper compartment and a lower compartment therein, said upper compartment adapted to contain said storage fluid, said lower compartment adapted to contain seawater or a gas;
   f. first valve means for injecting seawater into and removing seawater from said lower compartment of each said cylindrically shaped enclosure and said second enclosure;
   g. second valve means capable of passing a gas into and out of said lower compartment of each said cylindrically shaped enclosure.

2. The apparatus of claim 1 further including valve means third valve for venting said gas as said gas expands as said apparatus ascends from the seafloor to the sea surface.

3. The apparatus of claim 1 wherein said compartment creating means includes a flexible membrane.

4. The apparatus of claim 1 wherein said storage fluid injecting and removing means includes a pipeline connected to each said upper compartment through a respective conduit having a valve therein.

5. The apparatus of claim 1 wherein said cylindrically shaped enclosures are disposed with their longitudinal axes parallel.

6. The apparatus of claim 5 wherein each said cylindrically shaped enclosure is divided into a plurality of sub-enclosures by a plurality of respective circular bulkheads disposed perpendicular to said longitudinal axis of said cylindrically shaped enclosures.

7. The apparatus of claim 1 wherein said apparatus contains two cylindrically shaped enclosures.

8. The apparatus of claim 1 wherein the volume of said second enclosure is substantially equal to the volume of one said cylindrically shaped enclosure.

9. The apparatus of claim 1 wherein said apparatus further includes:

a. ballast means located in one end of said cylindrically shaped enclosure such that said apparatus tilts in the water; and b. a lowering line attached to said second enclosure.

10. A method of raising and lowering a mobile underwater seafloor storage structure comprising a pair of cylindrically shaped enclosures having hemispherical-shaped end members, said cylindrically shaped enclosures being connected by a top, bottom and side members such that a second enclosure is formed between said pair of cylindrically shaped enclosures, the longitudinal axes of said cylindrically shaped enclosures being parallel; comprising the steps of:

a. filling both said cylindrically shaped enclosures with a storage fluid bearing said second enclosure empty;

b. draining the storage fluid from one said cylindrically shaped enclosure into said second enclosure so that said cylindrically shaped enclosures are disposed vertically;

c. attaching a lowering line to said structure;

d. placing a ballast in one end of said cylindrically shaped enclosure such that said structure tilts in the water; and e. rendering said structure negatively buoyant.

11. The method of claim 10 comprising the further steps of:

a. lowering said structure to the seafloor;

b. filling said drained cylindrically shaped enclosure with seawater such that said structure is firmly anchored to said seafloor.

12. The method of claim 11 further comprising the steps of:

a. disposing valves on said storage fluid-filled, cylindrically shaped enclosure and said storage fluid-filled second enclosure such that when opened said storage fluid is automatically pumped to the sea surface due to a pressure differential.

13. The method of claim 12 further comprising the steps of:

a. displacing the seawater in said seawater filled, cylindrically shaped enclosure with a gas rendering said structure positively buoyant such that a moment arm is created tending to dislodge said structure from the seafloor;

b. venting the gas from said cylindrically shaped enclosure as the gas expands due to decreased pressure upon it as said structure ascends.

* * * * *